US010208406B2

(12) United States Patent
Yakushi

(10) Patent No.: US 10,208,406 B2
(45) Date of Patent: Feb. 19, 2019

(54) METHOD AND DEVICE FOR CUTTING LAP IN COMBER

(71) Applicant: KABUSHIKI KAISHA TOYOTA JIDOSHOKKI, Kariya-shi, Aichi-ken (JP)

(72) Inventor: Makoto Yakushi, Kariya (JP)

(73) Assignee: KABUSHIKI KAISHA TOYOTA JIDOSHOKKI, Kariya-shi, Aichi-ken (JP)

( * ) Notice: Subject to any disclaimer, the term of this patent is extended or adjusted under 35 U.S.C. 154(b) by 111 days.

(21) Appl. No.: 15/337,178

(22) Filed: Oct. 28, 2016

(65) Prior Publication Data

US 2017/0121864 A1 May 4, 2017

(30) Foreign Application Priority Data

Nov. 2, 2015 (JP) ..... 2015-215783

(51) Int. Cl.
*D01G 19/14* (2006.01)
*D01G 19/06* (2006.01)

(52) U.S. Cl.
CPC ..... *D01G 19/14* (2013.01); *D01G 19/06* (2013.01)

(58) Field of Classification Search
CPC ..... D01G 19/14; D01G 19/06; D01G 19/16; D01G 19/18; D01G 19/26; D01G 19/12; D01G 19/20; D01G 19/28
USPC ..... 19/229, 223
See application file for complete search history.

(56) References Cited

U.S. PATENT DOCUMENTS 1,245,919 A * 11/1917 Hindley ..... D01G 19/14 19/229
1,476,754 A * 12/1923 Horridge ..... D01G 19/14 74/436
1,678,822 A * 7/1928 Nasmith ..... D01G 19/14 19/225
2,145,491 A * 1/1939 Nasmith ..... D01G 19/14 19/232
2,145,492 A * 1/1939 Nasmith ..... D01G 19/14 19/225
2,180,172 A * 11/1939 Schmitt ..... D01G 1/10 19/0.35

(Continued)

FOREIGN PATENT DOCUMENTS

JP H4-222234 A 8/1992
JP 5-117921 A 5/1993

(Continued)

OTHER PUBLICATIONS

Communication dated Mar. 13, 2018 issued by the Japanese Patent Office in counterpart Japanese application No. 2015-215783.

*Primary Examiner* — Shaun R Hurley
*Assistant Examiner* — Bao-Thieu L Nguyen
(74) *Attorney, Agent, or Firm* — Sughrue Mion, PLLC

(57) ABSTRACT

A method for cutting a lap in a comber includes applying pressure to a bobbin toward a lap roller. The method further includes forming a weak portion in the lap that is continuous from the bobbin to a nipper device in the state in which pressure is applied to the bobbin by pulling the lap toward the nipper device. The method further includes cancelling the applied pressure after forming the weak portion. The method further includes applying tension to the lap after forming the weak portion to cut the lap at the weak portion.

4 Claims, 4 Drawing Sheets

(56) References Cited

U.S. PATENT DOCUMENTS 2,204,944 A * 6/1940 Nasmith ..... D01G 19/105 19/229
2,421,010 A * 5/1947 Cavedon ..... D01G 15/70 19/145.7
2,579,770 A * 12/1951 Uschmann ..... B27N 3/14 156/380.6
2,706,834 A * 4/1955 Wilkie ..... D01G 1/10 19/0.37
2,992,458 A * 7/1961 Witschi ..... A61F 13/2085 19/106 R
3,103,041 A * 9/1963 Nydam ..... D01G 19/04 19/225
3,209,410 A * 10/1965 New ..... D01G 1/10 19/0.51
3,339,243 A * 9/1967 Keishi Sato ..... D01H 5/22 19/247
3,522,634 A * 8/1970 Morrison ..... D01G 1/10 19/0.6
3,536,140 A * 10/1970 Looker ..... A01D 45/008 171/61
3,600,758 A * 8/1971 VonKaenel ..... D01G 19/06 19/225
3,718,944 A * 3/1973 Clark ..... D01G 19/02 19/123
3,751,768 A * 8/1973 Morrison ..... D01H 5/02 19/244
RE27,764 E * 10/1973 Morrison et al. ..... D01G 1/10 19/0.6
RE28,414 E * 5/1975 Keesling et al. .... B65H 16/028 242/527.5
4,109,453 A * 8/1978 Kobayashi ..... D01H 4/32 19/105
4,122,582 A * 10/1978 Van Vliet ..... D01G 5/00 19/304
4,419,791 A * 12/1983 Schar ..... B65H 51/30 19/123
4,489,461 A * 12/1984 Hasegawa ..... D01H 5/22 19/258
4,494,371 A * 1/1985 Morita ..... D01H 4/48 57/263
4,572,418 A * 2/1986 Hirata ..... B41J 13/0018 226/101
4,672,717 A * 6/1987 Shimomura ..... D01G 19/16 19/225
4,928,357 A * 5/1990 Clement ..... D01G 19/06 19/225
4,996,747 A * 3/1991 Wichtermann ..... D01G 19/08 19/115 R
5,005,262 A * 4/1991 Ackeret ..... D01G 19/26 19/234
5,022,122 A * 6/1991 Clement ..... D01G 19/26 19/115 A
5,027,475 A * 7/1991 Mondini ..... D01G 19/08 19/115 R
5,038,441 A * 8/1991 Mondini ..... D01G 19/08 19/115 R
5,062,183 A * 11/1991 Mondini ..... D01G 19/06 19/225
5,271,126 A * 12/1993 Clement ..... D01G 19/18 19/231
5,303,453 A * 4/1994 Langel ..... D01G 19/08 19/115 R
5,430,917 A * 7/1995 Inagaki ..... D01G 19/08 19/115 R
5,467,506 A * 11/1995 Nishikawa ..... D01G 19/16 19/115 R
5,495,643 A * 3/1996 Katori ..... D01G 19/16 19/215
5,638,580 A * 6/1997 Kim ..... D01H 5/22 19/236
5,755,135 A 5/1998 Strobel et al.
5,775,086 A * 7/1998 Stahlecker ..... D01H 4/32 19/105
5,778,493 A * 7/1998 Moretti ..... D01G 19/08 19/115 R
6,167,595 B1 * 1/2001 Prandini ..... D01G 19/08 19/115 R
6,431,813 B2 * 8/2002 Sugaya ..... B65B 69/0058 414/403
6,449,805 B2 * 9/2002 Slavik ..... D01G 19/14 19/115 R
6,550,105 B2 * 4/2003 Slavik ..... D01G 19/14 19/115 R
6,829,810 B2 * 12/2004 Riedel ..... D01H 4/32 19/115 R
6,845,597 B2 * 1/2005 Redmond ..... B65B 61/06 53/133.8
7,559,121 B2 * 7/2009 Perrotto ..... D01G 1/08 19/0.39
7,845,054 B2 * 12/2010 Schmitz ..... D01G 31/006 19/115 R
8,973,219 B2 * 3/2015 Shimbara ..... D01G 19/18 19/231
2012/0324677 A1 * 12/2012 Hao ..... D01C 1/02 19/5 A
2015/0009257 A1 * 1/2015 Endo ..... B41J 2/32 347/16

FOREIGN PATENT DOCUMENTS

JP H8-285567 A 11/1996
JP H9-194087 A 7/1997

* cited by examiner

METHOD AND DEVICE FOR CUTTING LAP IN COMBER

BACKGROUND OF THE INVENTION

The present invention relates to a method and device for cutting a lap in a comber, and more particularly, to a method and device for cutting a lap when changing laps.

In a comber, when the remaining amount of a used lap, or a primary lap, becomes small, lap splicing is performed to overlap and join an end of the primary lap (primary lap end) with a starting end of a new lap reel. When the lap splicing is performed automatically, the primary lap needs to be cut automatically.

Japanese Laid-Open Patent Publication No. 5-117921 discloses a conventional method for automatically cutting a primary lap. In this method, when the remaining amount of the primary lap wound around a bobbin becomes small when cutting the lap, the bobbin is pressed against two lap rollers by further rollers. In this state, the lap sheet is cut by reversing the rotation of the bobbin, that is, by rotating the bobbin in the direction that winds the lap sheet around the bobbin. More specifically, when the bobbin on the lap roller is almost empty, the operation of the base frame is stopped. A pipe presses the lap sheet that is being fed toward a movable guide plate, which is located at a guide position, to hold the lap sheet with the movable guide plate. Then, an air cylinder of a bobbin pressing mechanism is actuated. When the air cylinder is actuated, pressing levers move the bobbin with the further rollers to a pressing position. When located at the pressing position, the bobbin is pressed toward the lap rollers. A lap motor is driven in this state. This rotates the bobbin in the direction that winds the lap sheet around the bobbin and cuts the lap sheet between the pressing position where the lap sheet is pressed by the pipe and an abutment position where the bobbin abuts the lap rollers.

The bobbin pressing mechanism includes two support plates spaced apart by a distance that is substantially the same as the length of the bobbin. Each support plate extends in the vertical direction and includes two guide pins, namely, an upper guide pin and a lower guide pin. Each support plate supports a corresponding one of the pressing levers that includes two elongated holes. More specifically, the elongated holes are engaged with the guide pins so that the support plates support the pressing levers in a movable manner. The pressing levers each include a distal end, to which a corresponding one of the further rollers is coupled. The axis of each further roller extends in the axial direction of the lap rollers. The air cylinder is fixed below the space between the two support plates. A piston rod of the air cylinder is fixed to the middle of another lever so that the other lever is horizontal. The other lever includes two ends, to which the lower ends of the two pressing levers are respectively coupled. The two pressing levers are each moved to a standby position when the piston rod is moved to a projecting position, and the two pressing levers are each moved to a pressing position when the piston rod is moved to a pulling position. When located at the standby position, the two additional rollers are located beside the bobbin. When located at the pressing position, the two additional rollers engage the lower inner circumferential surface of the bobbin and press the bobbin toward the lap rollers.

The method described in Japanese Laid-Open Patent Publication No. 5-117921 requires the bobbin pressing mechanism and the structure in which the fed lap sheet is pressed by the pipe toward the movable guide plate, which is located at the guide position. Further, the method requires the complicated bobbin pressing mechanism including the further rollers that press the bobbin toward the lap rollers while allowing rotation of the bobbin, the pressing levers that rotationally support the further rollers with bearings, and the air cylinder that moves the pressing levers between the pressing position and the waiting position.

When rotation of the bobbin is reversed by the lap rollers without using the bobbin pressing mechanism (pressure applying device), only the weight of the lap bobbin keeps the bobbin held on the lap rollers. When the weight per unit length of the lap is heavy or the fiber length of the lap is long, the lap has a strong tension. In this case, the weight of the bobbin is not enough to resist slipping of the bobbin. This may hinder cutting of the lap and cause the surface of the remaining lap to be uneven.

SUMMARY OF THE INVENTION

It is an object of the present invention to provide a method and device for cutting a lap in a comber including a simple pressure applying unit that applies pressure to a bobbin acting toward a lap roller to allow for stable lap cutting.

To achieve the above object, a method for cutting a lap in a comber according to one aspect of the present invention includes applying pressure to a bobbin toward a lap roller. The method further includes forming a weak portion in the lap that is continuous from the bobbin to a nipper device in the state in which pressure is applied to the bobbin by pulling the lap toward the nipper device. The method further includes cancelling the applied pressure after forming the weak portion. The method further includes applying tension to the lap after forming the weak portion to cut the lap at the weak portion.

According to a further aspect of the present invention, a device for cutting a lap in a comber is provided. The comber includes a lap roller that is rotatable in forward and reverse directions and a bobbin arranged on the lap roller. The device includes a bobbin pressure applying unit. The bobbin pressure applying unit includes a piston engageable with the bobbin, a pressing unit that presses the piston so that the piston is in a pressure-applying state, and a returning unit that returns the piston to a non-pressure-applying state.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment of the present invention will now be described with reference to FIGS. 1 to 5. In this specification, the left, right, upper, and lower sides as viewed in FIG. 1 respectively correspond to front, rear, upper, and lower directions.

A comber generally includes a plurality of (for example, eight) combing heads 11.

Figure 1:
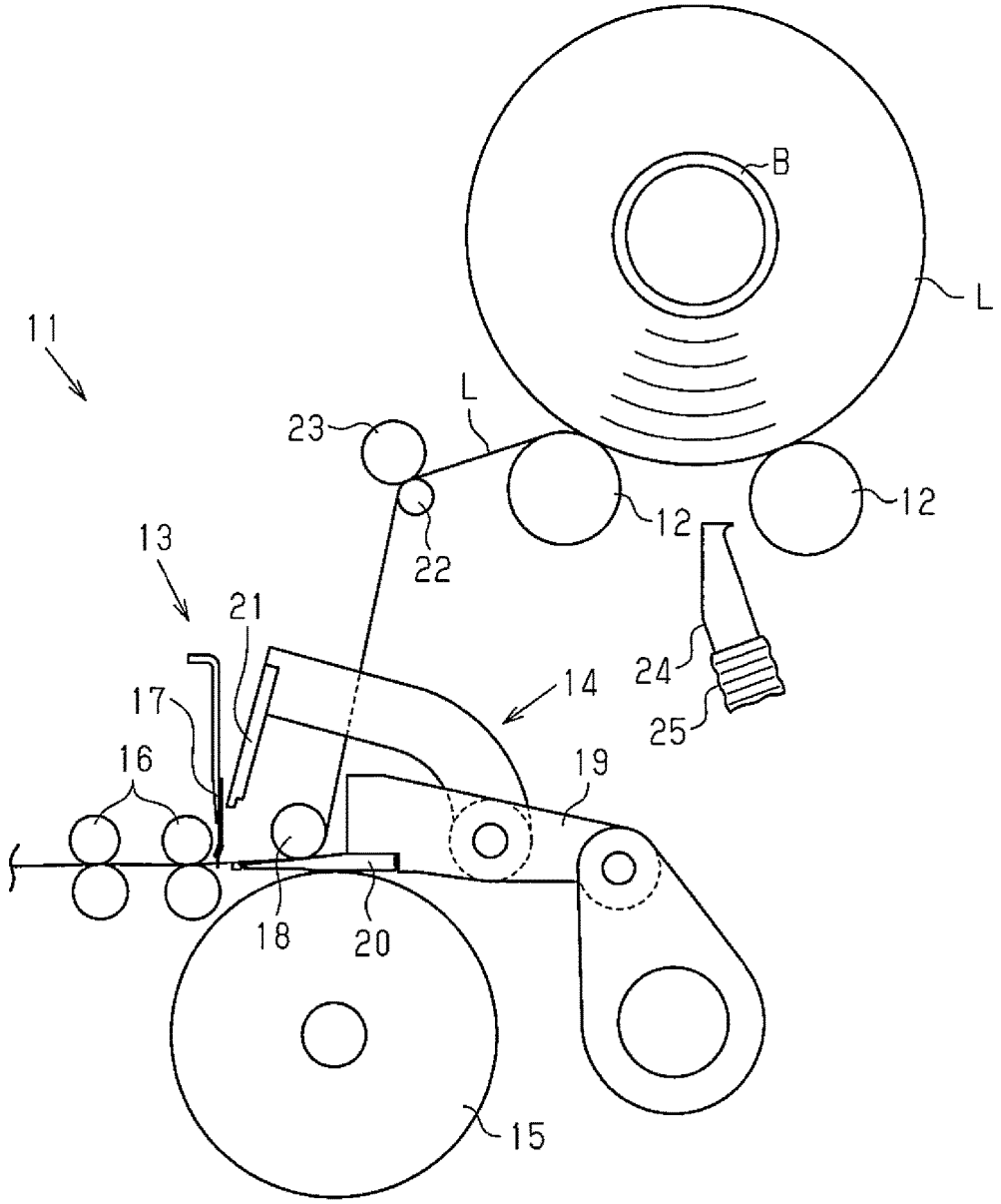
FIG. 1 is a schematic side view showing a combing head according to one embodiment of the present invention.

As shown in FIG. 1, each combing head 11 includes two lap rollers 12. A bobbin B around which a lap L is wound is mounted on the two lap rollers 12. A combing unit 13 is arranged at the lower side (downstream side) of the lap rollers 12. The combing unit 13 includes a nipper device 14, a combing cylinder 15, detaching rollers 16, and a top comb 17. The detaching rollers 16 are arranged in front of the combing cylinder 15 in two rows, that is, in a front row and in a rear row.

The lap rollers 12 are driven by a lap roller motor that can be driven independently from the combing unit 13. The lap roller motor generates forward and reverse rotation and is driven by an inverter device, which is controlled by instructions from a controller.

The nipper device 14 includes a feed roller 18 and a nipper frame 19 that is located at the upper side of the combing cylinder 15. The nipper frame 19 is pivotal in the forward and reverse directions. The nipper frame 19 includes a front bottom portion that defines a bottom nipper 20. The nipper frame 19 includes a top nipper 21 that opens and closes at a predetermined timing in synchronization with pivoting of the top nipper 21 and holds the lap L in cooperation with the bottom nipper 20.

A carrier roller 22 and a top roller 23 are arranged in front of the lap rollers 12 and above the nipper device 14. The carrier roller 22 is rotated by the same drive source as the combing unit 13. The top roller 23 is movable between an actuation position where the top roller 23 is pressed against the carrier roller 22 from the upper side and a retracted position where the top roller 23 is moved toward the upper side from the actuation position. The top roller 23 is held at the retracted position except when a lap is cut to change laps.

A suction nozzle 24 is arranged below the bobbin B, which is held on the lap rollers 12. A distal end of the suction nozzle 24 is located between the two lap rollers 12. The suction nozzle 24 includes an opening extending over the entire axial length of the bobbin B. The suction nozzle 24 is connected to a negative pressure source (not shown) by a hose 25.

Figure 2A:
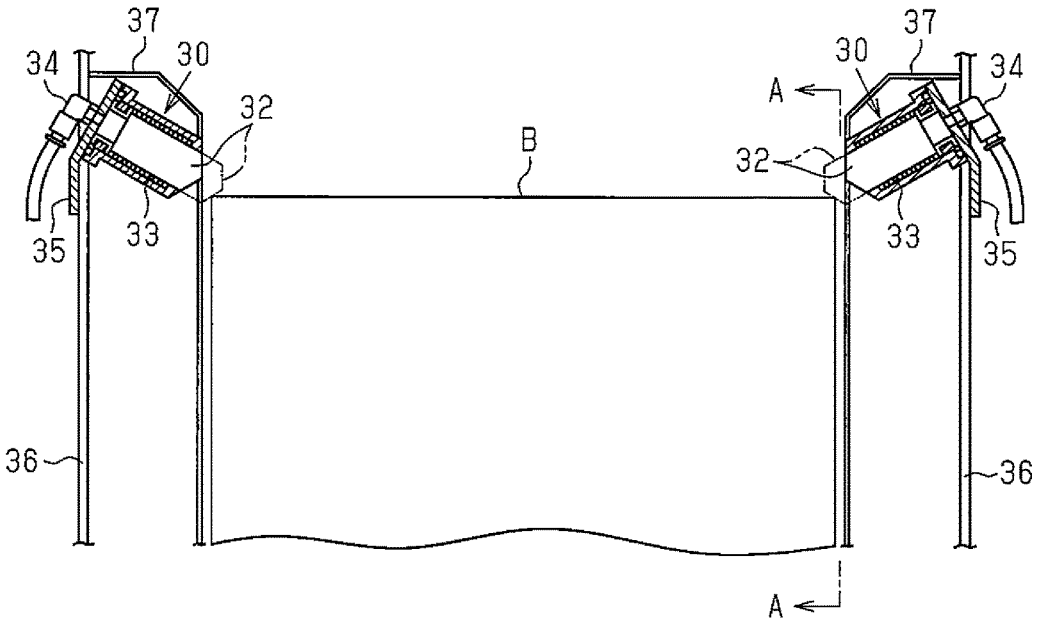
FIG. 2A is a partially cutaway, schematic front view of a bobbin shown in FIG. 1 and pressure applying units.
Figure 2B:
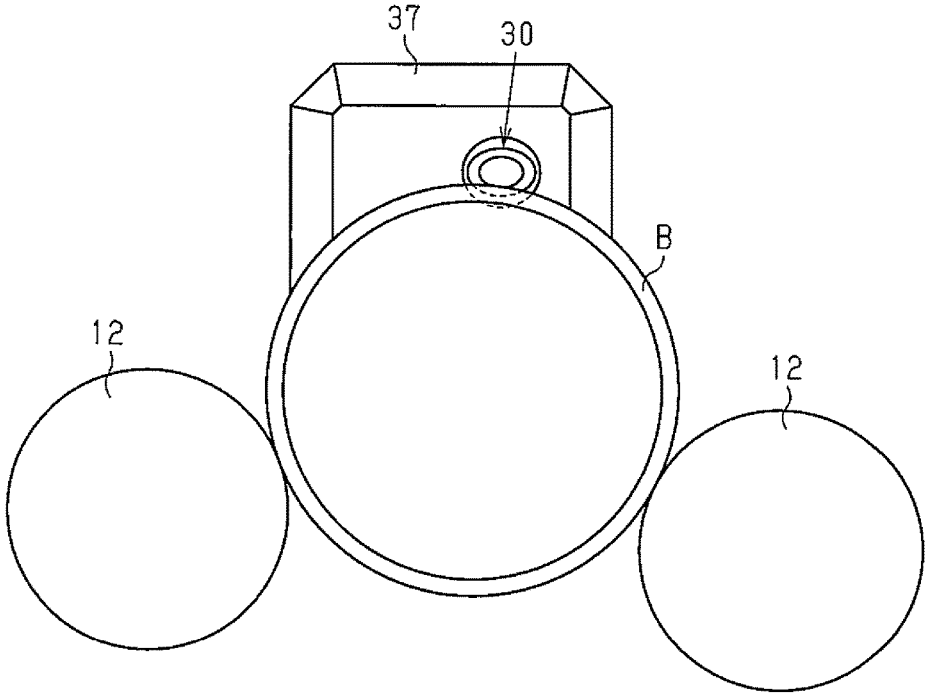
FIG. 2B is a schematic view of the bobbin, the pressing applying units, and lap rollers taken from line A-A in FIG. 2A.

As shown in FIGS. 2A and 2B, the combing head 11 includes bobbin pressure applying units 30. The bobbin pressure applying units 30 apply pressure to the upper portions of two ends of the bobbin B, which is mounted on the two lap rollers 12, toward the lower side when the bobbin B is almost empty. That is, the bobbin pressure applying units 30 apply pressure to the bobbin B in a direction the bobbin B presses the lap rollers 12. The bobbin B is almost empty when the amount of the lap L wound around the bobbin B decreases such that the surface of the bobbin B is partially exposed.

Figure 3A:
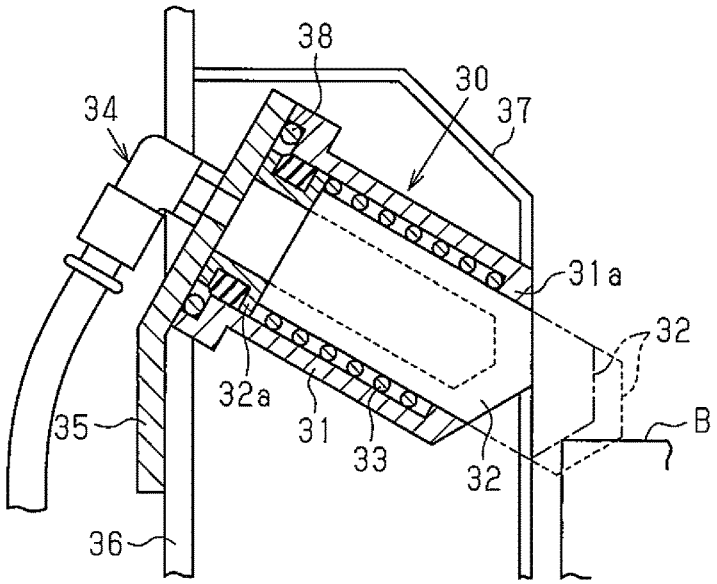
FIG. 3A is a cross-sectional view of the pressure applying unit shown in FIG. 2A.

As shown in FIGS. 2A and 3A, each bobbin pressure applying unit 30 includes a housing 31, a piston 32 accommodated in the housing 31 and engageable with the bobbin B on the lap rollers 12, a pressing unit that presses the piston 32 so that the piston 32 is in a pressure-applying state, and a returning unit that returns the piston 32 to a non-pressure-applying state. More specifically, the bobbin pressure applying unit 30 includes the housing 31 that is tubular, the piston 32 that includes a conic distal end and is allowed to be projected out of and retracted into a distal end of the housing 31, a coil spring 33 that biases the piston 32 to a retracted side, and a compressed air supplying unit 34 that supplies the housing 31 with compressed air.

As shown in FIG. 3A, the piston 32 includes a basal end defining a guide 32*a* that has a larger diameter than the piston 32 and is movable along an inner surface of the housing 31. The coil spring 33 includes one end engaged with an engagement portion 31*a*, which is formed in the inner surface of the distal end of the housing 31, and another end engaged with the guide 32*a*. The coil spring 33 is accommodated in the housing 31 with the two ends of the coil spring 33 engaged with the housing 31. The compressed air supplying unit 34 serves as a pressing unit that presses the piston 32 so that the piston 32 is in a pressure-applying state, and the coil spring 33 serves as the returning unit that returns the piston 32 to a non-pressure-applying state. The compressed air supplying unit 34 is connected to a compressed air supply source (not shown) by a pipe (not shown). Compressed air is supplied to or discharged from the housing 31 in accordance with a supplying operation or discharging operation performed by an electromagnetic valve.

The housing 31 is fixed to a machine frame 36 by a coupling bracket 35. The coupling bracket 35 is bent so that the piston 32 is directed obliquely downward. The housing 31 is coupled to the machine frame 36 so that the distal end of the piston 32 does not project from a lap guide 37 toward the bobbin B when in a non-pressure-applying state. An O-ring 38 is arranged between the inner surface of the basal end of the piston 32 and the coupling bracket 35. The lap guide 37 includes a hole that allows for smooth projection and retraction of the piston 32. The piston 32 includes a groove that receives a seal.

Figure 3B:
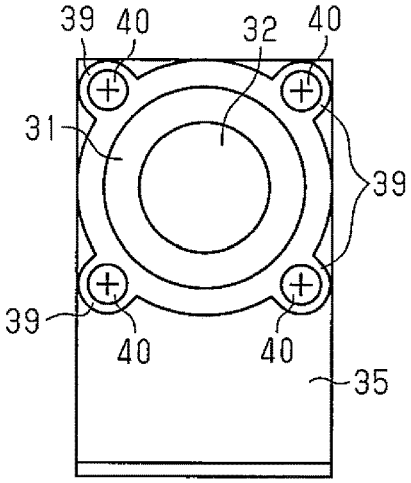
FIG. 3B is a schematic view of the pressure applying unit shown in FIG. 3A taken from the distal end of a piston.

As shown in FIG. 3B, the housing 31 includes a basal end that includes screw fastening portions 39. Screws 40 are inserted through the screw fastening portions 39 and fastened to screw holes of the coupling bracket 35 to fix the housing 31 to the coupling bracket 35. Further, as shown in FIG. 2B, the coupling bracket 35 is fixed to the machine frame 36 so that the piston 32 presses the bobbin B at a middle position between the two lap rollers 12.

The operation of the lap cutting device will now be described.

Laps are changed during operation of the comber when the bobbin B is almost empty, that is, when the amount of the lap on the bobbin B decreases to a predetermined value during operation of the comber. A detection signal of a sensor (not shown) is used to determine whether or not the bobbin B is almost empty. When the sensor detects the surface of the bobbin B, the base frame is stopped.

After the base frame is stopped, the electromagnetic valve (not shown) is actuated so that compressed air is supplied from the compressed air supplying unit 34 to the housing 31. Then, as shown by the broken line in FIGS. 2A and 3A, the piston 32 projects to a position where the piston 32 abuts against the upper end of the bobbin B. FIG. 3A shows a state in which the distal end of the piston 32 projects to a position where the distal end of the piston 32 abuts against the upper end of the bobbin B (double-dashed lines) and a position where the distal end of the piston 32 projects when the bobbin B does not exist (broken lines). That is, as the distal end of the piston 32 moves between the position where the distal end of the piston 32 abuts against the bobbin B and the position where the distal end of the piston 32 projects when the bobbin B does not exist, the piston 32 is maintained in a pressure-applying state in which the bobbin B is pressed against the lap rollers 12 by a pressing force exceeding the pressing force that compresses the coil spring 33.

Figure 4:
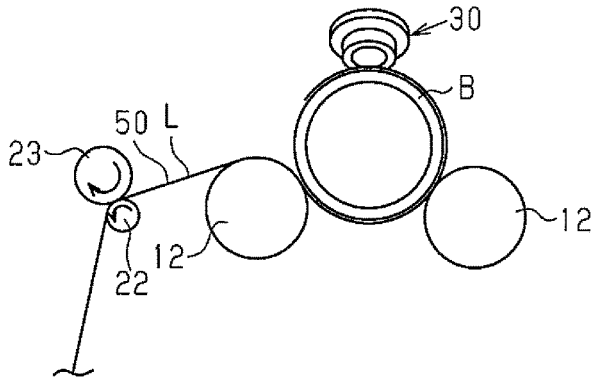
FIG. 4 is a schematic view showing a lap when extended.

Then, as shown in FIG. 4, when the driving of the lap rollers 12 is stopped, the base frame performs inching operations for a number of times so that the carrier roller 22, the nipper device 14, and the like, which are located at the downstream side of the lap rollers 12, are driven for an amount corresponding to several nips. This pulls the lap L, which is continuous from the bobbin B to the nipper device 14, toward the nipper device 14. It is preferred that the inching operations be performed, for example, three or four times although the optimal frequency of the inching operations performed changes in accordance with the raw material (material) of the lap L. The lap L is stretched by, for example, approximately 5 mm by a single nipping of the nipper device 14. The lap L stretched between the front lap roller 12 and the carrier roller 22 forms a weak portion 50.

Figure 5:
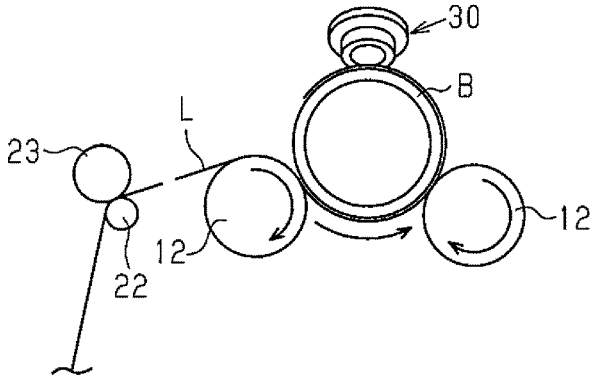
FIG. 5 is a schematic view showing the lap when cut.

Subsequently, the electromagnetic valve (not shown) performs a discharging operation to discharge compressed air out of the housing 31 so that the elastic force of the coil spring 33 returns the piston 32 to the original position and maintains the piston 32 in a non-pressure-applying state. Then, as shown in FIG. 5, the lap rollers 12 are driven in the reverse direction and rotated in the direction that winds the lap L around the bobbin B. When tension is applied to the lap L, the weak portion 50 located between the front lap roller 12 and the carrier roller 22 is cut without slipping of the bobbin B.

This embodiment has the advantages described below.

(1) In the method for cutting a lap in a comber, when the bobbin B is almost empty, pressure is applied to the bobbin B toward the lap rollers 12. In this state, the base frame performs inching operations. Subsequently, the lap L that is continuous from the bobbin B to the nipper device 14 is pulled toward the nipper device 14. This forms the weak portion 50 in the lap L. After the weak portion 50 is formed, the pressure applied to the bobbin B is cancelled. Subsequent to the formation of the weak portion 50, tension is applied to the lap L to cut the lap L at the weak portion 50.

In this structure, when changing laps of the comber, the portion of the lap L that is continuous from the bobbin B to the nipper device 14 is pulled toward the nipper device 14. This gradually stretches the lap L without the bobbin B slipping and forms the weak portion 50 in the lap L. After the weak portion 50 is formed, the pressure applied to the lap L is cancelled, and tension is applied to the lap L. This cuts the lap L at the weak portion 50. Accordingly, the bobbin B is not rotated when the bobbin pressure applying unit 30 is applying pressure. Thus, the pressure applying unit (bobbin pressure applying unit 30) that applies pressure to the bobbin B toward the lap rollers 12 has a simple structure. This allows for stable cutting of the lap L.

(2) The cutting of the lap L (weak portion 50) by applying tension to the lap L is performed by reversing rotation of the lap rollers 12 after cancelling the applied pressure. When the lap L is cut at the weak portion 50, the base frame may perform further inching operations to pull the lap L toward the nipper device 14 (so that nipper device receives lap). However, the reversed rotation of the lap rollers 12 cuts the lap L within a shorter time.

(3) The comber includes the lap rollers 12, which are rotated in the forward and reverse directions, and the bobbin B, which is located on the lap rollers 12. The lap cutting device of the comber includes the bobbin pressure applying unit 30. Each bobbin pressure applying unit 30 includes the piston 32, which is engageable with the bobbin B, the pressing unit (compressed air supplying unit 34), which presses the piston 32 and applies pressure to the piston 32, and the returning unit (coil spring 33), which returns the piston 32 to a non-pressure-applying state.

When changing laps of the comber, the bobbin pressure applying unit 30 applies pressure to the bobbin B that is almost empty. When applying pressure to the bobbin B, the pressing unit keeps applying pressure to the piston 32 of the bobbin pressure applying unit 30. In this structure, pressure is easily applied to the bobbin B. When the pressure is cancelled, the pressing unit stops the pressing so that the returning unit maintains the piston 32 in a non-pressure-applying state. This returns and holds the piston 32 at its original position in the non-pressure-applying state. That is, the application of pressure to the bobbin B and the cancellation of the pressure are performed by a single action of an air supply source (not shown) such as a pump. This simplifies the structure of the bobbin pressure applying unit 30 that applies pressure to the bobbin B toward the lap rollers 12. Accordingly, the lap L can be stably cut.

(4) The pressing unit uses compressed air to press the piston 32. The pressing unit may use, for example, a solenoid or the like. However, the use of compressed air limits the impact applied to the piston 32 as compared with when using a solenoid or the like.

(5) The piston 32 is directed obliquely downward. The piston 32 configured to move in the horizontal direction may apply force to the bobbin B that directs the bobbin B downward depending on the angle at which the distal end of the piston 32 engages the bobbin B. However, the pressing force of the pressing unit acts on the bobbin B more effectively when the piston 32 is directed obliquely downward than when the piston 32 is configured to move in the horizontal direction.

It should be apparent to those skilled in the art that the present invention may be embodied in many other specific forms without departing from the spirit or scope of the invention. Particularly, it should be understood that the present invention may be embodied in the following forms.

Figure 6:
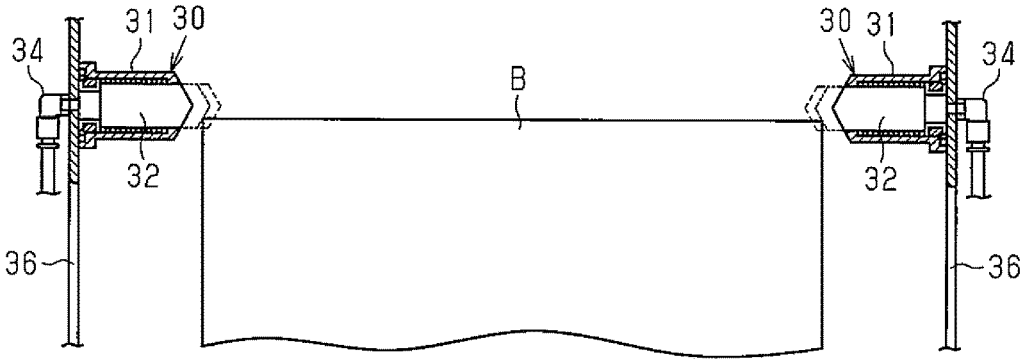
FIG. 6 is a partially cutaway, schematic front view of pressure applying units and a bobbin in another embodiment.

As shown in FIG. 6, the bobbin pressure applying units 30 may be arranged so that the pistons 32 are movable in the horizontal direction. The distal end of each piston 32 has the form of, for example, a cone that allows the piston 32 to press an end of the bobbin B obliquely downward when the piston 32 moves in the horizontal direction to abut against the end of the bobbin B. In this case, even when the piston 32 is configured to move in the horizontal direction, the piston 32 presses the bobbin B obliquely downward. Further, the housing 31 may be directly fixed to the machine frame 36 by the screws 40 without using the coupling bracket 35.

The distal end of the piston 32 does not have to be conical and may be, for example, pyramidal or spherical.

When the piston 32 is arranged obliquely downward, the distal end of the piston 32 may be flat.

The cutting of the weak portion 50 by applying tension to the lap L may be performed by increasing the number of times the inching operation is performed instead of reversing rotation of the lap rollers 12.

The pressing unit does not have to supply compressed air to press the piston 32 in the projection direction. Instead, for example, the piston (plunger) may be driven by a solenoid.

The returning unit does not have to be the coil spring 33.

The bobbin pressure applying unit 30 does not have to press the bobbin B from the two sides and may press the bobbin B from one side.

The carrier roller 22 and the top roller 23 may be omitted. In this case, the weak portion 50 may be formed in the lap L by performing the inching operations to rotate the feed roller 18.

The carrier roller 22 may be rotated by a motor that is independent from the combing unit 13 instead of a configuration in which the drive source is common to the carrier roller 22 and the combing unit 13 and the carrier roller 22 is rotated by the inching operation of the base frame. In this case, the base frame does not have to be inched when forming the weak portion 50 at the lap L.

The present invention may be applicable when changing laps at any timing instead of using a detection signal of a sensor that detects the surface of the bobbin B.

The present examples and embodiments are to be considered as illustrative and not restrictive, and the invention is not to be limited to the details given herein, but may be modified within the scope and equivalence of the appended claims.

The invention claimed is:

1. A method for cutting a lap in a comber, the method comprising:

applying pressure to a bobbin toward a lap roller;

forming a weak portion in the lap that is continuous from the bobbin to a nipper device in the state in which pressure is applied to the bobbin by pulling the lap toward the nipper device;

cancelling the applied pressure after forming the weak portion; and applying tension to the lap after forming the weak portion to cut the lap at the weak portion.

2. The method according to claim 1, wherein the applying tension to the lap includes reversing rotation of the lap roller after cancelling the applied pressure.

3. The method according to claim 1, wherein the lap roller is formed by a pair of lap rollers disposed at a lower portion of the bobbin, and wherein the pressure is applied to an upper portion of the bobbin while the bobbin is not being rotated, thereby causing the bobbin to press against the pair of lap rollers.

4. The method according to claim 3, wherein the weak portion is formed by stretching the lap between a front one of the pair of lap rollers and a carrier roller disposed downstream from the front one of the pair of lap rollers, and after the weak portion is formed, the applied pressure to the bobbin is cancelled, and after the applied pressure to the bobbin is cancelled, the pair of lap rollers are rotated in reverse thereby applying tension to the lap.

* * * * *